US006628908B2

(12) United States Patent
Matsumoto et al.

(10) Patent No.: US 6,628,908 B2
(45) Date of Patent: Sep. 30, 2003

(54) TONER SUPPLY UNIT AND IMAGE FORMING APPARATUS

(75) Inventors: Junichi Matsumoto, Ohta-ku (JP); Nobuo Kasahara, Ohta-ku (JP); Nobuo Iwata, Ohta-ku (JP); Satoshi Muramatsu, Ohta-ku (JP); Tomoyuki Ichikawa, Ohta-ku (JP); Yoshio Hattori, Ohta-ku (JP); Tomotoshi Nakahara, Ohta-ku (JP); Takaaki Yanagisawa, Ohta-ku (JP); Masumi Sato, Ohta-ku (JP); Kouta Fujimori, Ohta-ku (JP); Kazuhisa Sudo, Ohta-ku (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 09/963,644

(22) Filed: Sep. 27, 2001

(65) Prior Publication Data

US 2002/0039502 A1 Apr. 4, 2002

(30) Foreign Application Priority Data

Sep. 28, 2000 (JP) ..... 2000-297354

(51) Int. Cl.[7] ..... G03G 15/08

(52) U.S. Cl. ..... 399/106; 399/12; 399/262; 222/325; 222/DIG. 1

(58) Field of Search ..... 399/92, 106, 258, 399/262, 12; 222/81, 82, 325, 336, 337, 340, 341, 373, 375, 378, 402.1, 402.25, DIG. 1

(56) References Cited

U.S. PATENT DOCUMENTS

| | | | | |
|---|---|---|---|---|
| 4,499,849 A | | 2/1985 | Tomita | |
| 4,547,059 A | | 10/1985 | Nagayama et al. | |
| 4,571,070 A | | 2/1986 | Tomita et al. | |
| 5,074,342 A | * | 12/1991 | Kraehn | 141/65 |
| 5,105,222 A | | 4/1992 | Ohta et al. | |
| 5,386,274 A | | 1/1995 | Sanpe et al. | |
| 5,576,816 A | * | 11/1996 | Staudt et al. | 399/262 |
| 5,592,267 A | | 1/1997 | Misago et al. | |
| 5,595,223 A | * | 1/1997 | Hayao | 141/375 |
| 5,638,159 A | | 6/1997 | Kai et al. | |
| 5,663,788 A | | 9/1997 | Sanpe | |
| 5,815,784 A | | 9/1998 | Kasahara et al. | |
| 5,875,380 A | | 2/1999 | Iwata et al. | |
| 5,878,317 A | | 3/1999 | Masuda et al. | |
| 5,953,567 A | | 9/1999 | Muramatsu et al. | |
| 5,962,783 A | | 10/1999 | Iwata et al. | |
| 5,987,298 A | | 11/1999 | Muramatsu et al. | |
| 6,112,046 A | | 8/2000 | Suzuki et al. | |
| 6,122,468 A | | 9/2000 | Sakamoto et al. | |
| 6,128,459 A | | 10/2000 | Iwata et al. | |
| 6,142,690 A | | 11/2000 | Yoshimura et al. | |
| 6,163,669 A | | 12/2000 | Aoki et al. | |
| 6,193,113 B1 | * | 2/2001 | Hidding | 222/325 |
| 6,198,895 B1 | | 3/2001 | Tsuda et al. | |
| 6,201,941 B1 | * | 3/2001 | Kasahara et al. | 399/258 |

(List continued on next page.)

FOREIGN PATENT DOCUMENTS

JP 2000-227706 8/2000

OTHER PUBLICATIONS

U.S. patent application Ser. No. 09/963,644, filed Sep. 27, 2001, pending.

(List continued on next page.)

*Primary Examiner*—Robert Beatty
(74) *Attorney, Agent, or Firm*—Oblon, Spivak, McClelland, Maier & Neustadt, P.C.

(57) ABSTRACT

The toner supply unit is provided with a preventing unit for preventing toner contamination due to toner leakage from that sealing valve. A mouth ring of the toner container is provided with the sealing valve. This valve is opened/closed by removing/inserting a nozzle.

19 Claims, 15 Drawing Sheets

U.S. PATENT DOCUMENTS

| | | | | |
|---|---|---|---|---|
| 6,249,304 | B1 | | 6/2001 | Sawayama et al. |
| 6,282,396 | B1 | | 8/2001 | Iwata et al. |
| 6,295,437 | B1 | | 9/2001 | Hodoshima et al. |
| 6,304,739 | B1 | * | 10/2001 | Katsuyama et al. ..... 399/262 |
| 6,337,957 | B1 | | 1/2002 | Tamaki et al. |
| 6,363,232 | B1 | * | 3/2002 | Flaherty ..... 399/106 |
| 6,381,435 | B2 | | 4/2002 | Shinohara et al. |
| 6,386,392 | B1 | * | 5/2002 | Argentieri et al. ..... 222/81 |
| 6,393,241 | B1 | * | 5/2002 | Matsumoto et al. ..... 399/258 |
| 6,501,913 | B2 | | 12/2002 | Hattori et al. |
| 6,505,014 | B2 | | 1/2003 | Aoki et al. |
| 6,505,022 | B2 | | 1/2003 | Kosuge et al. |
| 6,522,855 | B1 | | 2/2003 | Katoh et al. |

OTHER PUBLICATIONS

U.S. patent application Ser. No. 09/985,368, filed Nov. 2, 2001, allowed.
U.S. patent application Ser. No. 10/059,187, filed Jan. 31, 2002, pending.
U.S. patent application Ser. No. 10/133,484, filed Apr. 29, 2002, pending.
U.S. patent application Ser. No. 10/231,281, filed Aug. 30, 2002, pending.
U.S. patent application Ser. No. 10/316,156, filed Dec. 11, 2002, pending.
U.S. patent application Ser. No. 09/465,674, filed Dec. 17, 1999, unknown.
U.S. patent application Ser. No. 09/556,968, filed Apr. 24, 2000, pending.
U.S. patent application Ser. No. 09/785,234, filed Feb. 20, 2001, pending.
U.S. patent application Ser. No. 09/801,806, filed Mar. 9, 2001, pending.
U.S. patent application Ser. No. 09/910,080, filed Jul. 23, 2001, pending.
U.S. patent application Ser. No. 09/917,930, filed Jul. 31, 2001, pending.
U.S. patent application Ser. No. 09/943,505, filed Aug. 31, 2001, pending.
U.S. patent application Ser. No. 10/227,303, filed Aug. 26, 2002, pending.
U.S. patent application Ser. No. 10/227,308, filed Aug. 26, 2002, pending.
U.S. patent application Ser. No. 09/987,027, filed Nov. 13, 2001, pending.
U.S. patent application Ser. No. 10/073,237, filed Feb. 13, 2002, pending.
U.S. patent application Ser. No. 10/152,672, filed May 23, 2002, pending.
U.S. patent application Ser. No. 09/907,326, filed Jul. 17, 2001, unknown.
U.S. patent application Ser. No. 10/281,250, filed Oct. 28, 2002, pending.
U.S. patent application Ser. No. 09/826,789, filed Apr. 5, 2001, unknown.
U.S. patent application Ser. No. 09/945,839, filed Sep. 5, 2001, pending.
U.S. patent application Ser. No. 09/948,576, filed Sep. 10, 2001, pending.
U.S. patent application Ser. No. 09/984,236, filed Oct. 29, 2001, pending.
U.S. patent application Ser. No. 09/983,687, filed Oct. 25, 2001, pending.
U.S. patent application Ser. No. 09/988,142, filed Nov. 19, 2001, pending.
U.S. patent application Ser. No. 09/993,606, filed Nov. 27, 2001, pending.
U.S. patent application Ser. No. 10/041,582, filed Jan. 10, 2002, pending.
U.S. patent application Ser. No. 10/050,959, filed Jan. 22, 2002, pending.
U.S. patent application Ser. No. 10/050,955, filed Jan. 22, 2002, pending.
U.S. patent application Ser. No. 10/054,993, filed Jan. 25, 2002, pending.
U.S. patent application Ser. No. 10/079,878, filed Feb. 22, 2002, pending.
U.S. patent application Ser. No. 10/075,402, filed Feb. 15, 2002, pending.
U.S. patent application Ser. No. 10/083,159, filed Feb. 27, 2002, pending.
U.S. patent application Ser. No. 10/107,249, filed Mar. 28, 2002, pending.
U.S. patent application Ser. No. 10/102,629, filed Mar. 22, 2002, pending.
U.S. patent application Ser. No. 10/143,928, filed May 14, 2002, pending.
U.S. patent application Ser. No. 10/268,830, filed Oct. 11, 2002, pending.

* cited by examiner

TONER SUPPLY UNIT AND IMAGE FORMING APPARATUS

FIELD OF THE INVENTION

The present invention relates to a toner supply unit having a toner container loaded detachably on a main body of the unit such that a toner discharging portion faces downward (in the direction of gravitational force), in which when the toner container is loaded on the main body of the unit, an insertion member is inserted into the toner discharging portion so as to supply toner through the insertion member.

BACKGROUND OF THE INVENTION

Conventionally, it has been well known that in an image forming apparatus such as a printer, copier and the like, a toner container for storing toner such as a toner bottle, a toner cartridge and the like is set up on the main body of the same apparatus and toner is supplied from the container to a developing portion. In this kind of the toner container, a toner discharging port is closed with a cap or seal so that upon replacement of the container, user has to remove that cap or seal. However, this work causes scattering of toner or contamination by toner, therefore user does not like to do such a work. Thus, since before, various devices and proposal have been made for user to carry out the replacement work of the toner container comfortably.

For example, a toner container provided with a self-closing valve at a toner discharging port thereof has been already proposed. Such a toner container can be set up in the apparatus without removing the cap or seal. FIG. 23 shows an example of the toner container provided with the self-closing valve, which the same applicant as this application has already proposed.

Referring to FIG. 23, a mouth ring 23, in which the toner discharging port is formed of the toner container 20, is provided with a seal valve 60 made of non air-permeable sponge as the self-closing valve. Slits 65, which intersect each other substantially in the center, are formed in the sealing valve 60. On the other hand, a nozzle 40, which serves as an insertion member, is erected in a setting portion 50 in the main body of the apparatus in which the toner container 20 is to be set up. When the toner container 20 is set in the setting portion from above, the nozzle 40 is inserted through the slits 65 in the sealing valve 60. At this time, the slits 65 in the sealing valve 60 are outstretched so as to make firm contact with an external periphery of the nozzle 40 without any gap. If the toner container 20 is pulled out of the setting portion, the outstretched slits 65 return to their original states by elasticity of the sponge seal 22.

However, the aforementioned toner container 20 has such a problem that toner leaks from the slits 65 in the sealing valve 22, so that the setting portion 50 is contaminated. Major reasons for such a problem are as follows.

The nozzle 40 is not located in the center of the sealing valve 60. Moreover, when the nozzle 40 is inserted into the sealing valve 60 or removed therefrom, gap is generated between the slits 65 and the nozzle 40. Moreover, the sealing valve 60 creeps thereby lowering sealing effect. In addition, when the nozzle 40 is pulled out, toner deposited on the nozzle 40 upon setting spills out.

SUMMARY OF THE INVENTION

It is an object of this invention to provide a developing agent storage container and an image forming apparatus using the same container, capable of reducing toner contamination upon replacement and raising air-tightness of the container.

The toner supply unit according to one aspect of this invention comprises: a toner container that holds a toner, the toner container having a toner discharging portion for discharging the toner; a toner container holder that detachably holds the toner container in such a manner that the toner discharging portion faces in a direction of gravity; an insertion member that is inserted into the toner discharging portion while the toner container is held by the toner container holder, wherein toner is filled into the toner container through the insertion member; and a preventing unit for preventing toner contamination due to toner leakage through the self-closing valve, the preventing unit including a self-closing valve, provided to the toner discharging portion, which is opened or closed by removing or inserting the insertion member from/into the toner discharging portion.

The toner supply unit according to another aspect of this invention comprises: a toner container that holds a toner, the toner container having a toner discharging portion for discharging the toner; a toner container holder that detachably holds the toner container in such a manner that the toner discharging portion faces in a direction of gravity; an insertion member that is inserted into the toner discharging portion while the toner container is held by the toner container holder, wherein toner is filled into the toner container through the insertion member, the insertion member having a top surface and an opening on the top surface; and a self-closing valve, provided to the toner discharging portion, which is opened or closed by removing or inserting the insertion member from/into the toner discharging portion.

The toner supply unit according to still another aspect of this invention comprises: a toner container that holds a toner, the toner container having a toner discharging portion for discharging the toner; a toner container holder that detachably holds the toner container in such a manner that the toner discharging portion faces in a direction of gravity; an insertion member that is inserted into the toner discharging portion while the toner container is held by the toner container holder, wherein toner is filled into the toner container through the insertion member; and a suction unit having an suction port in the vicinity of a toner discharging portion of the toner container held by the toner container holder.

The image forming apparatus according to still another aspect of this invention comprises the toner supply unit according to the present invention.

Other objects and features of this invention will become apparent from the following description with reference to the accompanying drawings.

DESCRIPTION OF THE PREFERRED EMBODIMENTS

Embodiment of the present invention will be described in detail with reference to the accompanying drawings.

Figure 1:
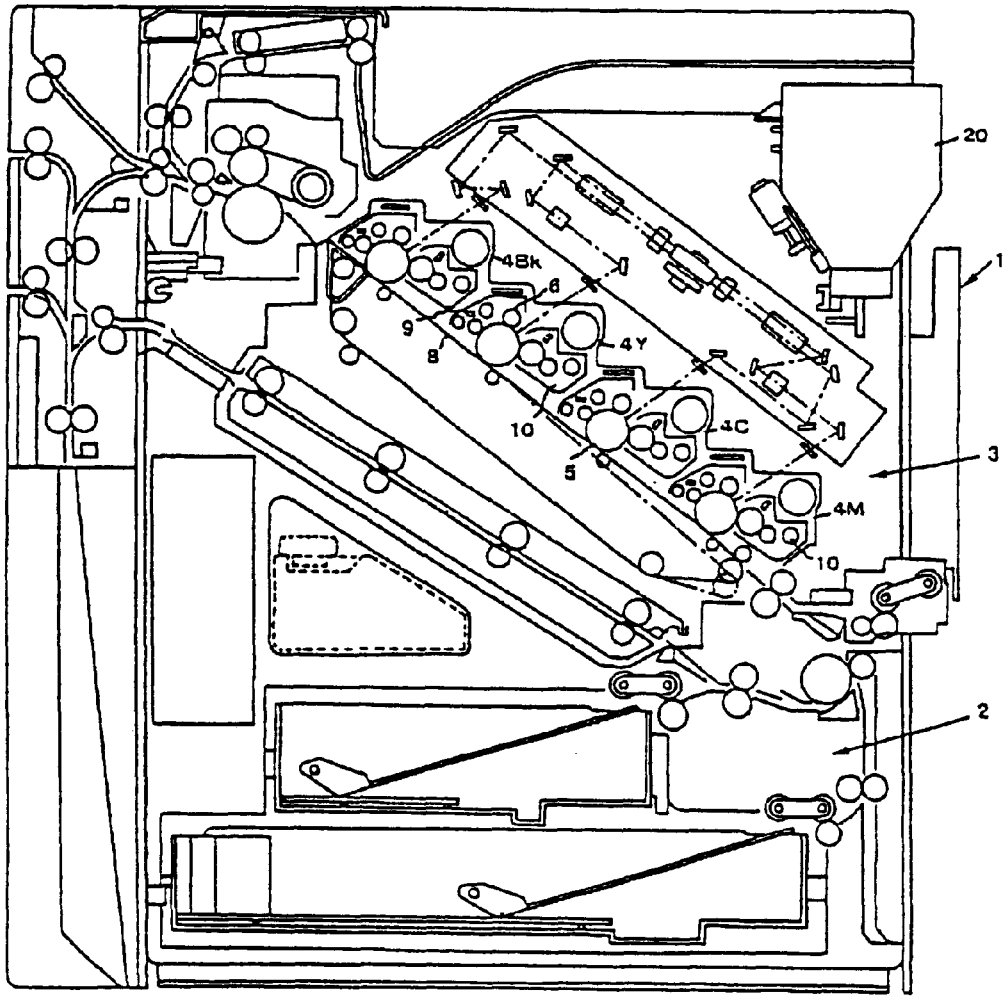
FIG. 1 is a schematic diagram showing an entire structure of an image forming apparatus of the present invention.

FIG. 1 is a schematic diagram showing a color laser printer which is an example of the image forming apparatus of the present invention. In this color laser printer, a paper feeding portion 2 is disposed at the bottom of an apparatus main body 1 and an image creating portion 3 is disposed above it. The image creating portion 3 includes a transfer belt unit disposed such that it is inclined with its paper supplying side down and its paper discharging side up. The transfer belt unit 8 has an endless transfer belt 8*a*, which is applied on plural belt wheels, that is, belt wheels 4 in this example, and four image creation units 4M, 4C, 4Y, 4Bk for magenta (M), cyan (C), yellow (Y) and black (Bk) are disposed in parallel on a traveling side above the transfer belt 8*a*.

Figure 2:
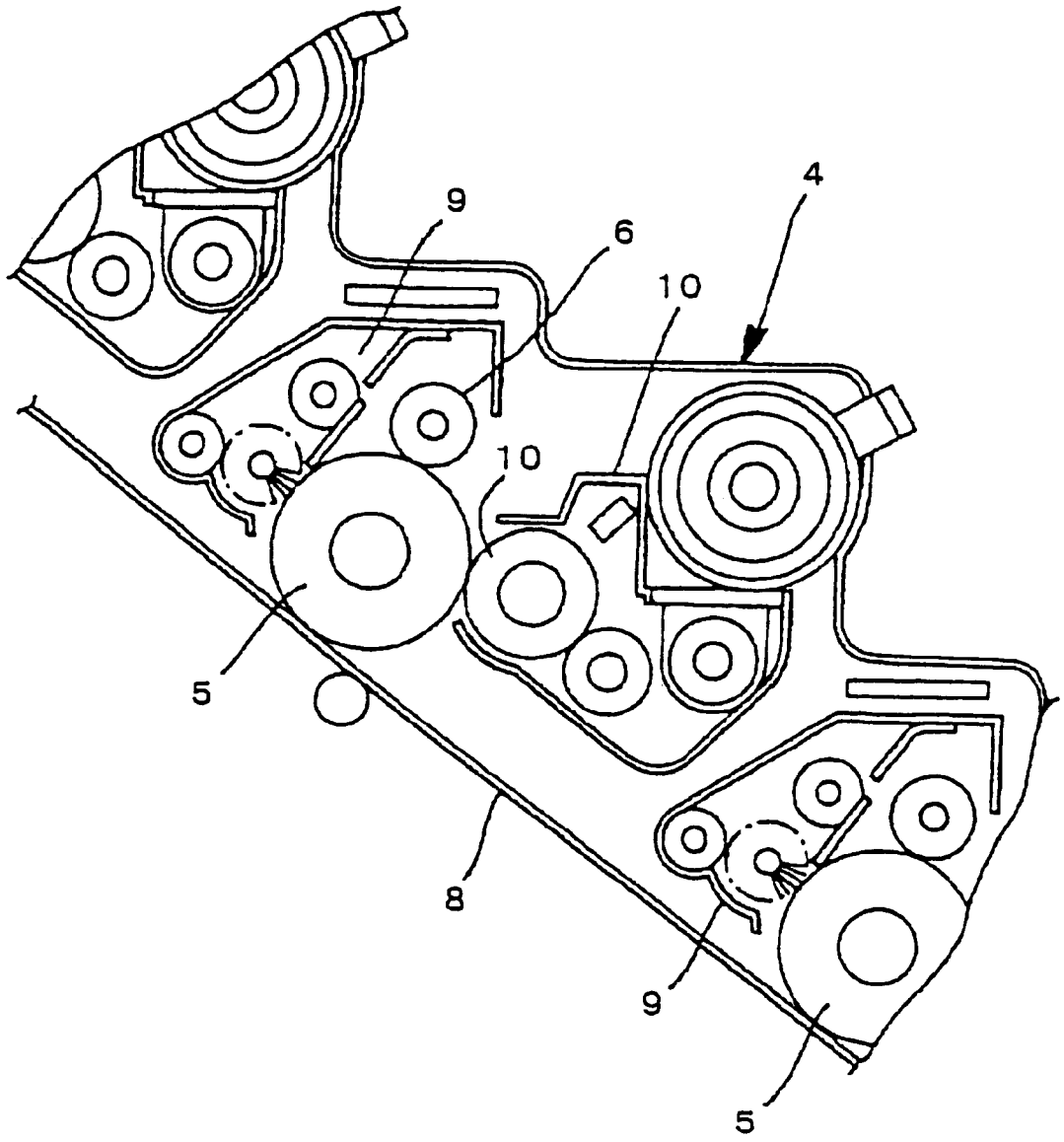
FIG. 2 is an explanatory diagram showing an image forming unit of the image forming apparatus of FIG. 1 in enlargement.

FIG. 2 is an explanatory diagram indicating an enlargement of some portion of an image creation unit 4. As shown in FIG. 1 and FIG. 2, the respective image creation units 4M, 4C, 4Y, 4Bk each includes a photoconductor drum 5 as each of their image carriers. The photoconductor drum 5 is rotated in a clockwise direction by a driving unit not shown. Around the photoconductor drum 5 are provided an electric charging roll 6, which is an electric charging unit, an optical writing portion which carries out write with laser beam by means of an optical writing unit 7, a developing unit 10, which is a developing unit, and a cleaning unit 9, which is a cleaning unit. The developing unit 10 is a two-component developing unit composed of toner and carrier, to which toner corresponding to an amount of consumed toner is supplied from a toner container 20 by means of a toner supply unit. The toner supply unit supplies toner accommodated in the toner containers, which are provided in the same quantity as the respective image creation units 4M, 4C, 4Y, 4Bk.

The developing unit 10 is provided with a uni-axial deflection screw pump, which is a suction type powder pump 11, such that it is disposed in the vicinity or integratedly. The structure of this powder pump 11 is comprised of a rotor 12 formed in the shape of an eccentric screw from material having stiffness such as metal, a stator 13 formed of elastic material such as rubber in the form of a two-row screw and a holder 14 formed of resin material, which wraps these and in which a transportation path for the powder is formed. The aforementioned rotor 12 is rotated by a gear 16 which is connected integratedly to a drive shaft 15 through a pin joint. Meanwhile, reference numeral 17 denotes an electromagnetic clutch, which controls activation of the power pump 11.

Figure 3:
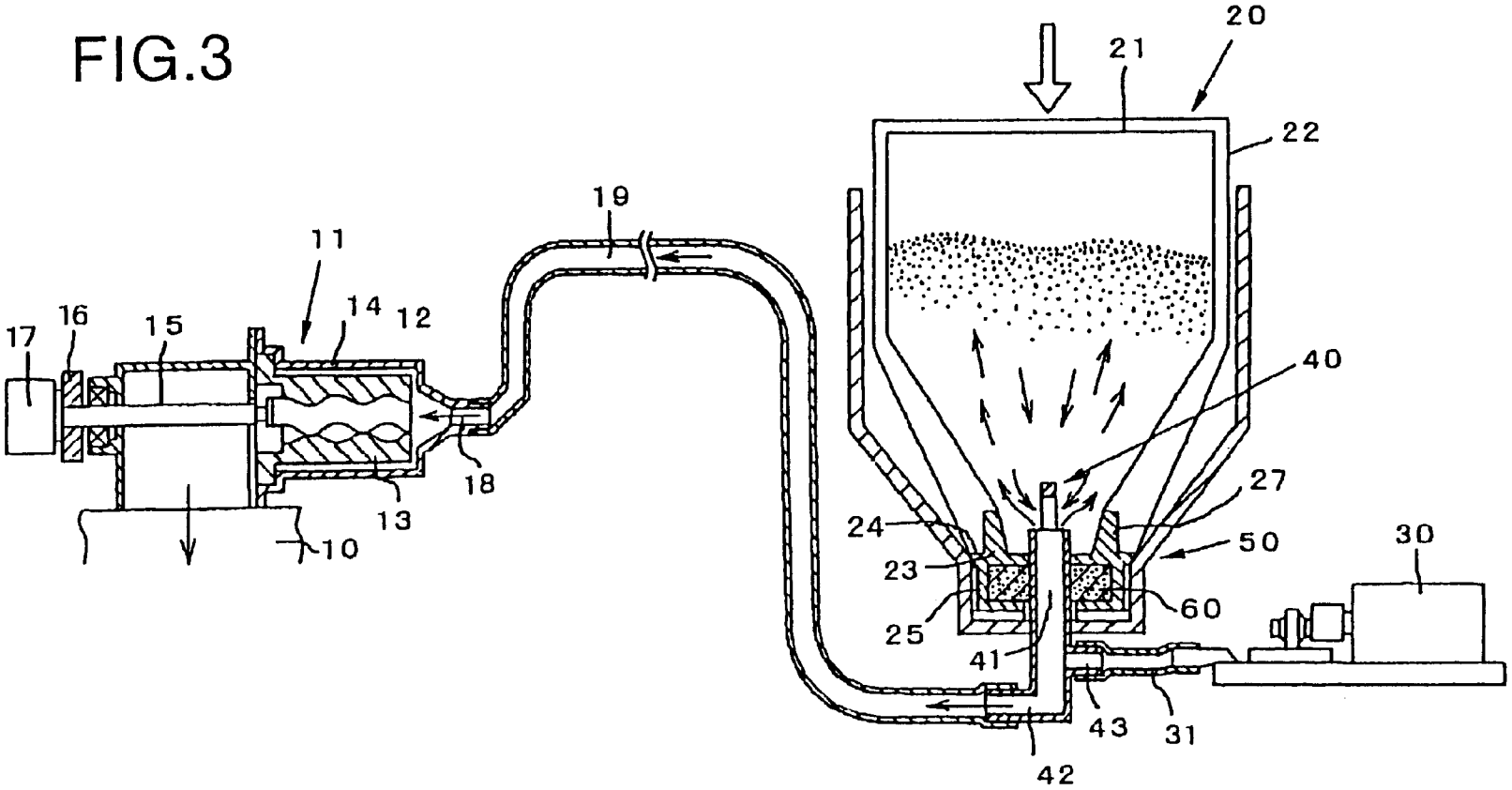
FIG. 3 is an explanatory sectional diagram showing an embodiment of a toner supply unit of the present invention.

A toner suction portion 18 is provided on a front end of the aforementioned holder 14 or on the right end in FIG. 3 and that toner suction portion 18 is connected to a toner connecting port 45 provided on a nozzle 40, which is an insertion member described later, through a toner transfer tube 19. This toner transfer tube 19 is of a flexible tube having a diameter of, for example, 4 to 10 mm and if the toner transfer tube is made of rubber material (for example, polyurethane, nitrile, silicone, etc.) having an excellent toner resistance, it is very effective, so that the flexible tube can be placed easily in any direction of upward/downward or to the right or left. The toner supply unit having such a structure is well known to be capable of transferring continuously by a predetermined amount at a high fixed air ratio by means of a uni-axial deflection screw pump, which is the powder pump 11 and secure an accurate transfer amount proportional to the rotation speed of the rotor 12. If a toner supply instruction is dispatched because of image density detection or the like, the powder pump 11 is actuated, so as to supply a demanded amount of toner to the developing unit 10.

On the other hand, a setting portion 50 provided on the main body 1 of an image forming apparatus, on which the toner container 20 is to be set up, is composed as a separate unit from the developing unit 10. A nozzle 40 having a circular cross section, which is to be inserted into the toner container 20, is erected and the toner container 20 set up in the setting portion 50 of the main body of the image forming apparatus from above. A sharp end member 44 formed to have a conical cross section is provided on a top of the nozzle 40 provided in the setting portion 50 by integral forming or fixing. A passage 41, which serves as an air supply path as well as a toner supply path, is provided following this sharp end member 44. An interior of the nozzle 40 is of a single pipe structure and the passage 41 is bent to the left in the same Figure at a bottom of the nozzle 40 and a toner connecting portion 42, to which the toner transfer tube 19 is connected, is provided at a front end thereof. Further, air connecting port 43 is provided on the passage 41 and bent to the right above the toner connecting port 42.

According to this embodiment, the air connecting port 43 is connected to an air pump 30 which acts as an air supply unit through an air transfer pipe 31. If this air pump 30 is actuated, air is injected into the toner container 20 through the air transfer pipe 31 and the passage 41. Then, the air injected into the toner container 20 passes through toner layer so as to fluidize the toner by diffusion.

The aforementioned toner container 20 is constructed in bag-in-box type comprised of a toner bag 21 which is deformable containing toner and an external box 22 having a higher stiffness than that bag for accommodating the toner bag. The toner bag 21 is formed of resin sheet of polyethylene, nylon or the like or paper sheet of, for example, 80-toner container 20 $\mu$m in the form of a single layer or plural layers. The toner bag 21 is formed according to blow formation method and a mouth ring 23 made of resin or the like having a toner discharge mouth is fixed. The mouth ring member 23 is comprised of a circular extended plate 24 provided on an external periphery substantially in the center in vertical direction, a cylindrical portion 25 provided under the extended portion 24 containing a sealing valve 26 inside and a ship-shaped portion 27 provided above the extended portion 24, on which the toner bag 21 is fixed. The cylindrical portion 25 passes through to the ship-shaped portion 27 so as to form an opening. The sealing valve 60 is provided as a self-closing valve in the opening on the side of the cylindrical portion 25. The sealing valve 60 is formed of elastic body composed of, for example, non air-permeable foamed sponge or the like.

Figure 4:
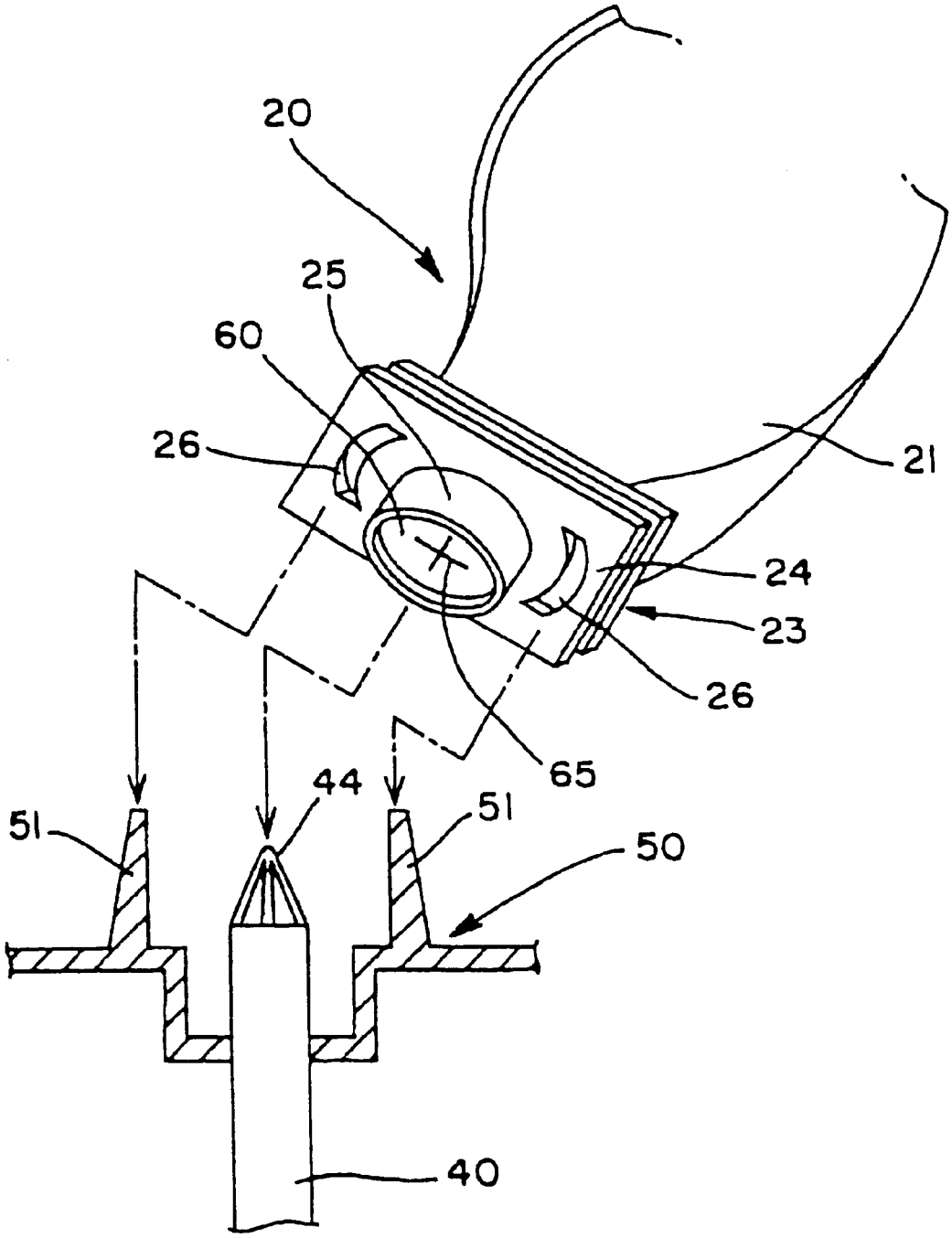
FIG. 4 is an explanatory diagram showing a setting portion of the toner container according to an embodiment of the present invention.

The sealing valve 60 has cross-shaped slits 65, which intersect each other substantially in the center as shown in FIG. 4 and the slits 65 are closed by elasticity of the sealing valve 60 thereby eliminating a fear that toner is scattered outside. When set in the setting portion 50 of the toner container 20, the slits 65 in the sealing valve 60 are opened in the axial directions by the nozzle 40. If it is released from the setting portion 50 of the toner container 20, the slits 65 are restored in an original state by elasticity so that the toner container 20 is closed. Meanwhile, the shape of the slits 65 is not restricted to cross, however as long as three or more lines are extended radially from the center, it may be employed. In this case, the slits are preferred to be spaced at an equal interval.

If the sealing valve 60 made of elastic body such as non air-permeable foamed sponge is used, the nozzle 40 is not located in the center of the sealing valve 60. If the nozzle 40 is inserted into the sealing valve 60 or pulled out, a gap is generated between the slits 65 and the nozzle 40, so that the sealing valve 60 creeps thereby reducing sealing effect. Or toner deposited on the nozzle 40 at the time of setting drops out when the nozzle 40 is pulled out, so that toner leaks from the slits 65 in the sealing valve 60, thereby contaminating the setting portion 50. Thus, this toner supply unit is provided with a preventing unit for protecting from toner contamination.

In FIG. 4, a nozzle guide 51 is provided in the setting portion 50 as a guide convex portion in the vicinity of the nozzle 40. On the other hand, a guide hole 26 is provided in the mouth ring 23 of the toner container 20 as a guide concave portion, which engages the nozzle guide 51. According to this embodiment, this nozzle guide 51 and the guide hole 26 compose a guide unit for introducing the nozzle 40 to the center of the sealing valve 60.

Figure 5:
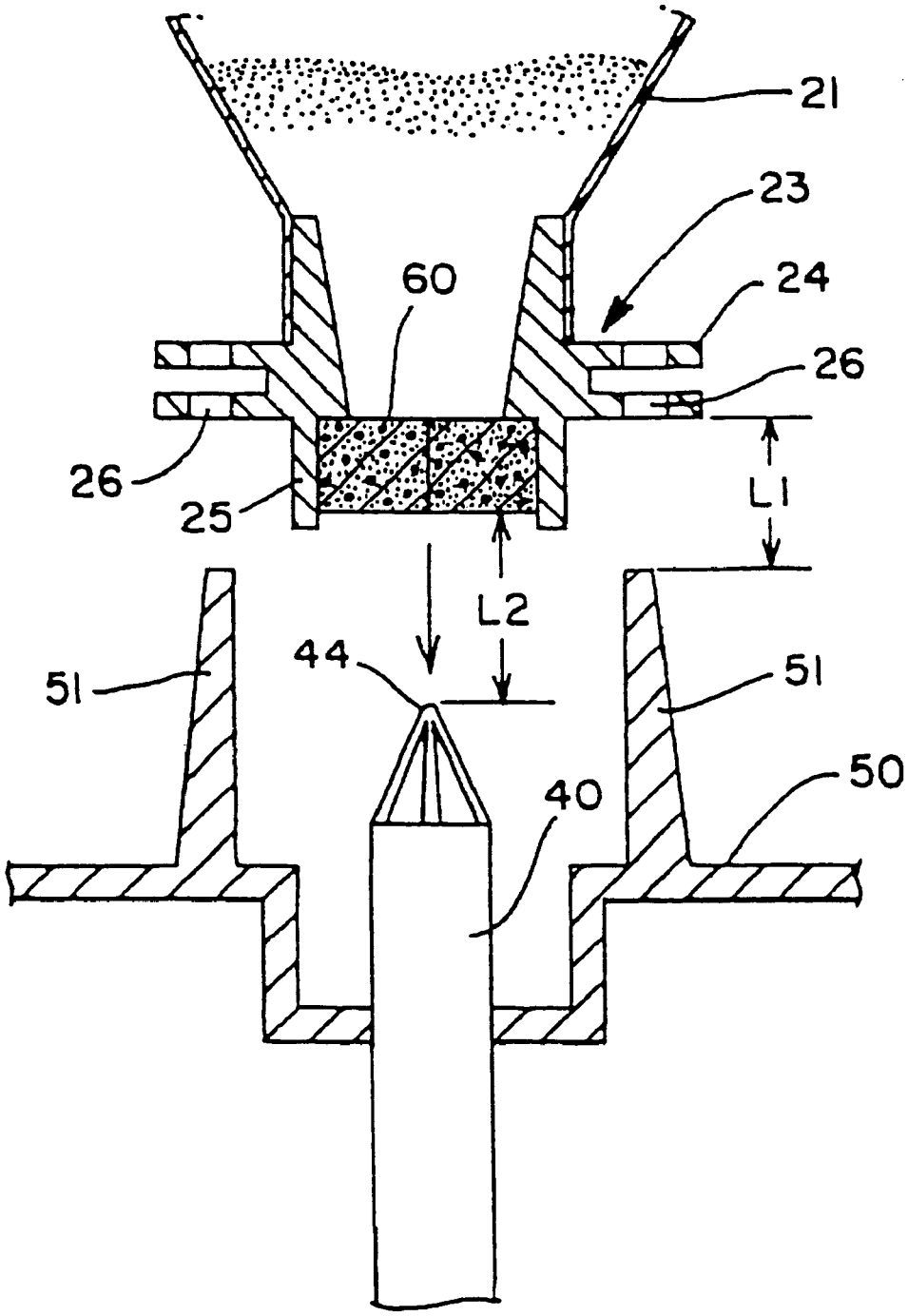
FIG. 5 is an explanatory sectional diagram of a setting portion in the toner container shown in FIG. 4.

In the toner supply unit having such a structure, by engaging the nozzle guide 51 with the guide hole 26 when setting the toner container 20, the toner container 20 is guided to a proper setting position so that the nozzle 40 is inserted into the center of the sealing valve 60. Thus, it is possible to prevent toner leakage which may be generated unless the nozzle 40 is located in the center of the sealing valve 60. In this case, by forming the nozzle guide 51 higher than the nozzle 40, the length L1 from the nozzle guide 51 to the guide hole 26 in FIG. 5 can be set shorter than the length L2 from a front end of the nozzle 40 to the sealing valve. If $L1<L2$ is set up, when setting the toner container 20, the nozzle guide 51 having a smaller distance engages the guide hole 26 first and after that, the nozzle 40 is inserted into the slits 65 in the sealing valve 60. Therefore, the toner container 20 is set at a proper position by the guide unit which engages first, thereby preventing the nozzle 40 from being deflected from the center of the slits 65.

Figure 6:
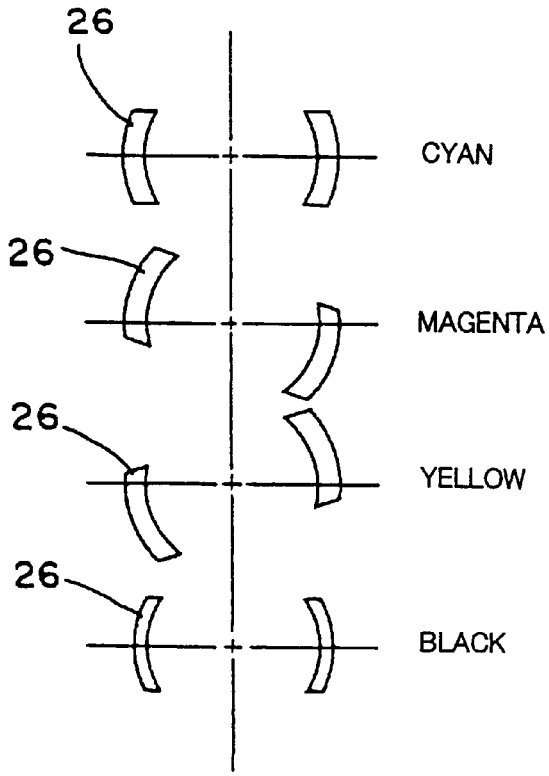
FIG. 6 is an explanatory diagram for explaining color non-compatibility of the above-described embodiment.

If two or more kinds of toners are used like the aforementioned color image forming apparatus, this toner supply unit can use this system for color non-compatibility. That is, because as shown in FIG. 6, the width or position of the nozzle guide 51 can be changed for each toner color accommodated, the position of the guide hole 26 in each color container changes so as to ensure color toner non-compatibility. The reason why, in the example shown in FIG. 6, the shapes of the nozzle guides 51 for cyan and black are similar is that the non-compatibility does not have to be ensured by changing the width or position of the nozzle guide 51 because the external boxes 22 of cyan and black are different.

Figure 7:
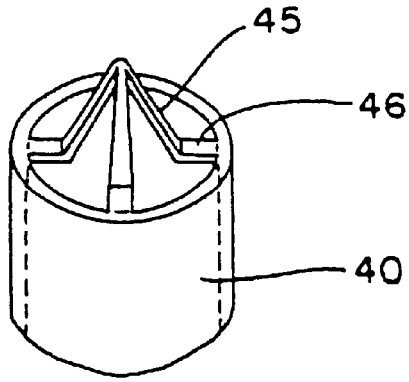
FIG. 7 is an explanatory diagram of a nozzle according to other embodiment of the present invention.
Figure 8:
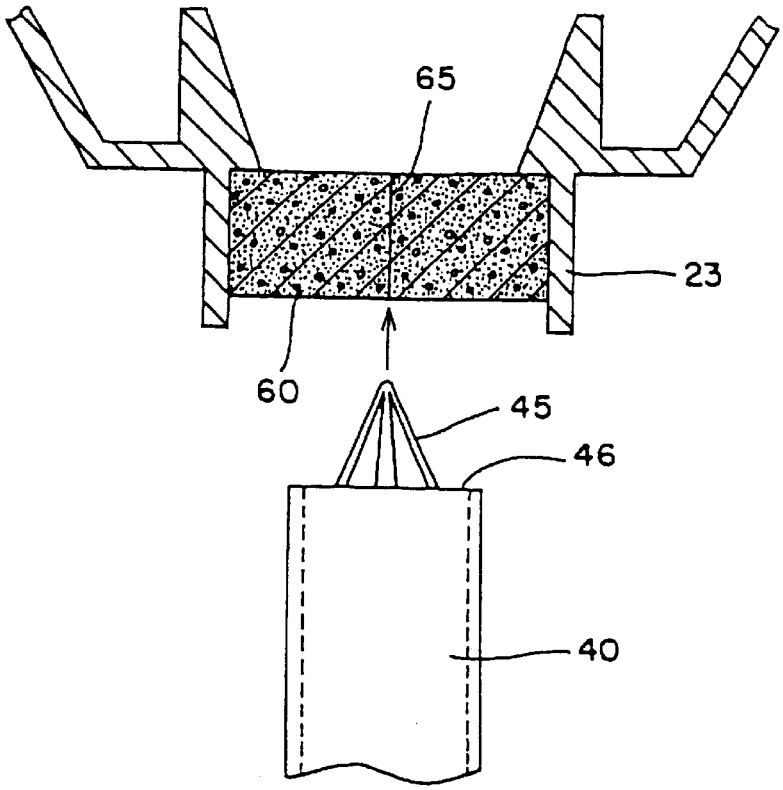
FIG. 8 is an explanatory sectional diagram of the setting portion using a nozzle of FIG. 7.
Figure 9:
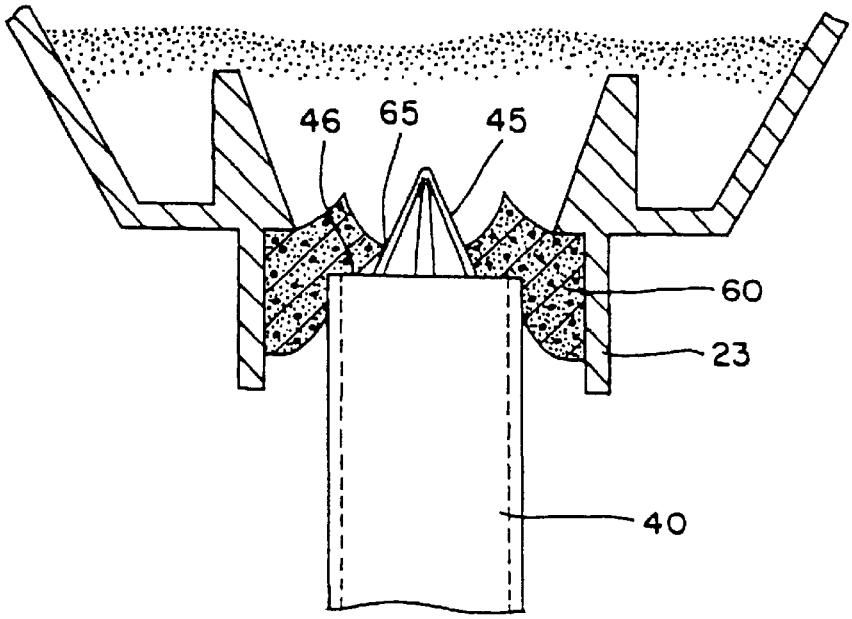
FIG. 9 is an explanatory sectional diagram showing a state in which the toner container of FIG. 8 is set up.

FIG. 7 and FIG. 8 are a perspective view and a sectional view showing other embodiment of the present invention. In this example, a top face of the nozzle 40 is open and an insertion portion 45, which is to be inserted into the slits 65 in the sealing valve 60 and a compression portion 46 for compressing the sealing valve 60 are provided on a top face thereof. In this case, the compression portion 46 is formed with a flat face rib having an appropriate width on the side of an external periphery of the top face of the nozzle 40 while the insertion portion 45 is formed so as to be erected in the form of a pyramid.

When the toner container 20 is set in the setting portion 50, the sealing valve 60, which is a sponge, is pressed by the compression portion 46, so that the nozzle 40 having such a structure 40 is compressed in a vertical direction and consequently, the insertion portion 45 is jumped into the container above the sealing valve 60. That is, if the diameter of the sealing valve is set larger than that of the compression portion 46 and the compression length is set shorter than the length of the insertion portion 45, when the sealing valve 60 is compressed, the insertion portion 45 can be jumped above the sealing valve 60.

With this structure, only the insertion portion 45 is inserted into the slits 65 in the sealing valve 60 and even if toner drops out of the slits 65 due to a gap which is generated between the insertion portion 45 and the slits 65 when the toner container 20 is pulled out of the setting portion 50, that leaking toner drops on the compression portion 46 so that it enters the passage 41. Therefore, toner contamination due to toner leakage from the slits 65 can be reduced remarkably.

Figure 10:
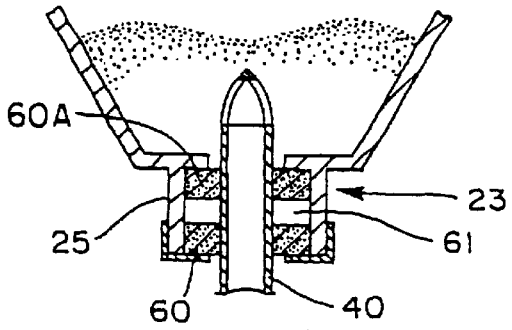
FIG. 10 is an explanatory sectional diagram of the toner container according to other embodiment of the present invention.

FIG. 10 shows further other embodiment of the present invention. According to this embodiment, the cylindrical portion 25 of the mouth ring 23 is provided with external sealing valve 60 and internal sealing valve 60A, made of two elastic bodies such as non air-permeable foamed sponge. The external sealing valve 60 is disposed at a bottom on a front end of the cylindrical portion 25 of the mouth ring 23 while the internal sealing valve 60A is disposed at a top portion within the cylindrical portion 25, so that space 61 is formed between the external sealing valve 60 and the internal sealing valve 60A. Then, the aforementioned slits 65 are formed in the external sealing valve 60 and the internal sealing valve 60A and their external peripheral faces are bonded to an internal wall of the cylindrical portion 25.

Figure 11A:
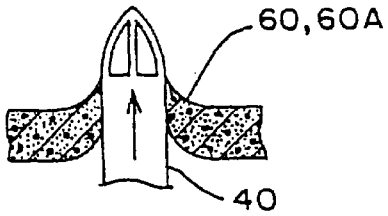
FIG. 11A and FIG. 11B are explanatory diagrams showing a motion of the sealing valve upon removal from/insertion into the toner container.
Figure 11B:
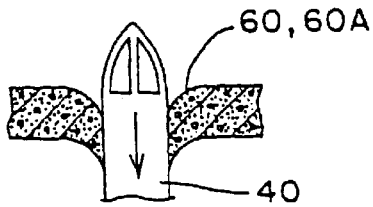

In the toner supply unit having such a structure, when with the toner container 20 set up, the nozzle 40 invades into the container, the external sealing valve 60 and the internal sealing valve 60A are provided with such a freedom that they follow motions of the nozzle 40 as shown in FIG. 11A. Thus, it is not likely to form a gap between the slits 65 in the external sealing valve 60 and the internal sealing valve 60A and the nozzle 40. Further, when taking out the toner container 20 also, the external sealing valve 60 and the internal sealing valve 60A are so deformed as to follow the motion of the nozzle 60 as shown in FIG. 11B. Thus, it is not likely to generate a gap between the slits 65 in the external sealing valve 60 and the internal sealing valve 60A and the nozzle 40. Therefore, toner leakage from the slits 65, which occurs when the toner container is mounted or unloaded, can be reduced.

Figure 12:
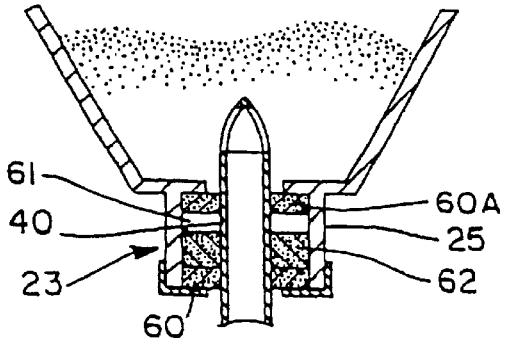
FIG. 12 is an explanatory sectional diagram showing a modification of FIG. 10.

FIG. 12 shows a modification of the embodiment of FIG. 10, in which a free movable seal 62 made of foamed sponge is provided in space 61 provided between the external sealing valve 60 and the internal sealing valve 60A. This movable seal 62 is so formed that its outer periphery contacts an internal wall of the cylindrical portion 25 and slits are formed in the center thereof. The thickness of the movable seal 62 is set shorter than the width in a vertical direction thereof. Therefore, the movable seal 62 is so constructed as to be capable of moving vertically within the width of the space 61.

Figure 13:
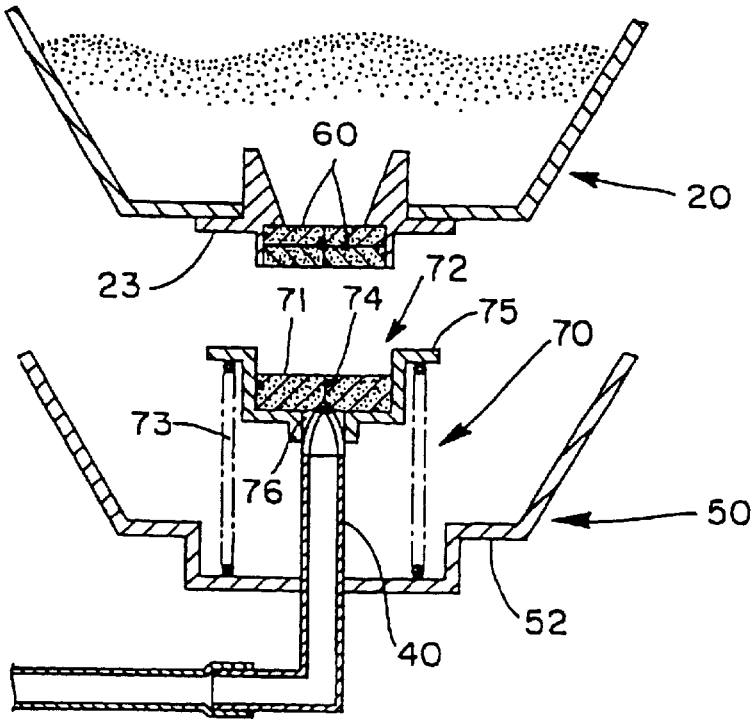
FIG. 13 is an explanatory sectional diagram of the setting portion according to further other embodiment of the present invention.

FIG. 13 is a sectional view showing part of the setting portion 50 according to further other embodiment of the present invention.

Referring to FIG. 13, a preventing unit 70, which engages the nozzle 40 movably, is provided as a unit for preventing toner contamination. The preventing unit 70 comprises a seal 71 made of elastic body such as sponge provided on a face opposing the toner container 20, a supporting frame 72 for supporting the seal 71 and a spring 73, which is an elastic unit for applying a upward pressing force to the supporting frame. The seal 71 has slits 74 in the center thereof and is fixed to a supporting frame 72 by bonding or the like. The supporting frame 72 is a member having a concave cross section, having with a jaw portion 75 on an external periphery of the top portion thereof. A hole 76, to which the nozzle is fit movably, is provided in the center of the concave portion 40 and the depth of the concave portion in the supporting frame 72 is set larger than the thickness of the seal 71.

The aforementioned spring 73 is a coil spring mounted between a machine frame 52 of the setting portion 50 and the supporting frame 72 so as to press the jaw portion 75 of the supporting frame 72. When the toner container 20 is not set up, the spring 73 holds the aforementioned supporting frame 72 at the highest position shown in FIG. 13. The length and strength of the spring 73 are set up so that the nozzle 40 does not slip out of the hole 76 in the supporting frame 72 at this time. Meanwhile, top and bottom ends of the spring 73 are preferred to be fixed to the supporting frame 72 and the machine frame 52 by bonding.

Figure 14:
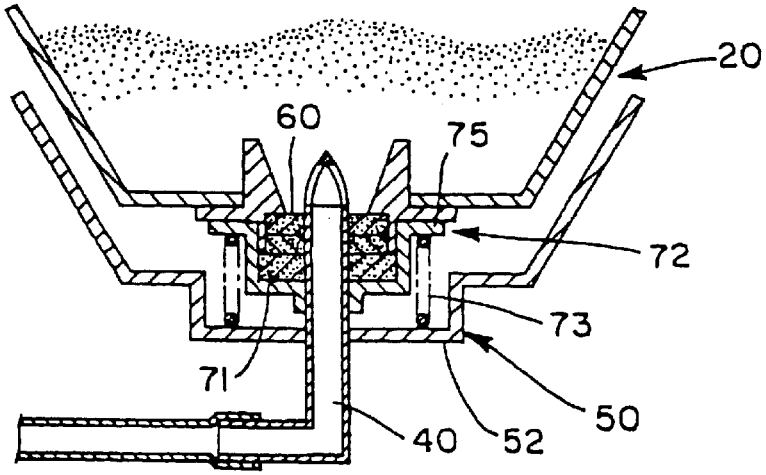
FIG. 14 is an explanatory sectional diagram showing toner container setting time of FIG. 13.
Figure 15:
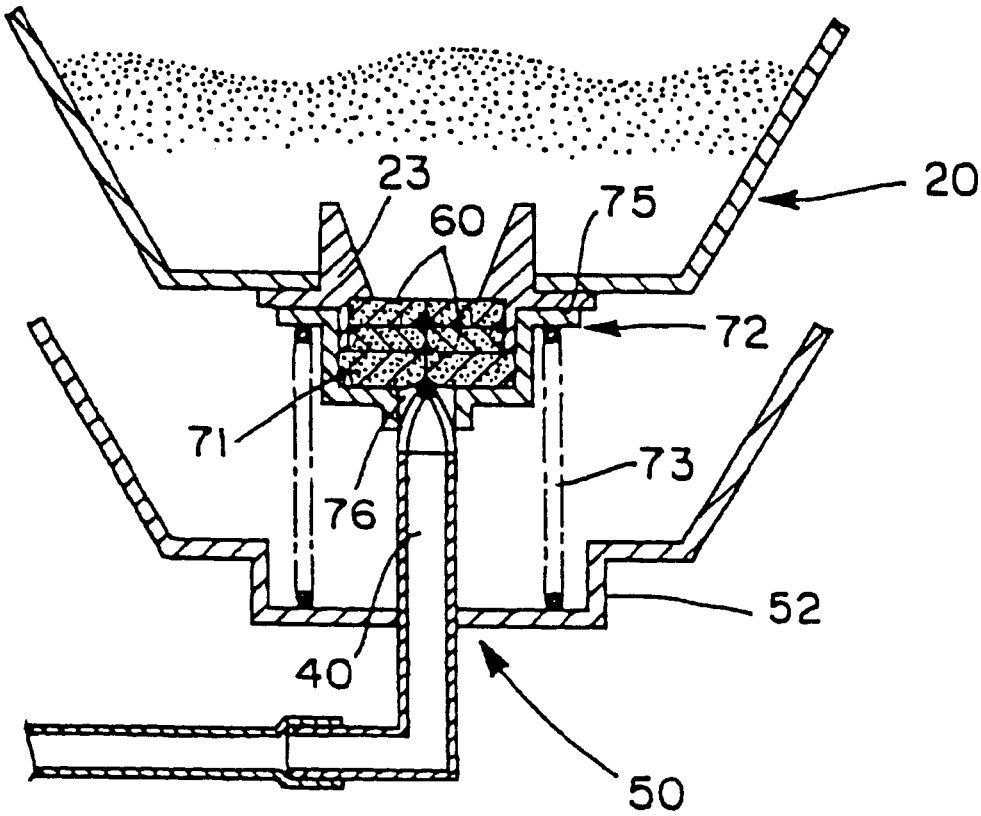
FIG. 15 is an explanatory sectional diagram showing a state in which the set toner container of FIG. 13 is popped up.

In the toner supply unit having such a structure, when the toner container 20 is set in the setting portion 50, as shown in FIG. 14, the supporting frame 72 is pressed against the mouth ring 23 of the container and with the nozzle 40 engaged, moves downward resisting a upward pressing force of the spring 73, so that a front end of the nozzle 40 is inserted into the container. At this time, the cylindrical portion 25 of the mouth ring 23 engages the concave portion in the supporting frame 72, so that the sealing valve 60 make firm contact with the seal 71. Because at this time, the spring 73 always applies upward elastic force to the toner container 20 through the supporting frame 72, a stopper unit (not shown) for holding the toner container 20 at the setting position is provided. As this stopper unit, an engaging pawl or the like for making engagement at the top of the toner container 20 is effective. Next, if the toner container 20 is taken out of the setting portion 50, as shown in FIG. 15, the supporting frame 72 is pressed up to a position where the sealing valve 60 of the toner container is closed, by the spring 73 and then, the supporting frame 72 follows the motion of the toner container 20. Therefore, even if the sealing valve 60 does react immediately when the nozzle 40 slips out and is not closed soon, so that toner leakage occurs, the leaking toner can be received by the seal 71. Thus, it is possible to avoid contamination of the setting portion 50 with scattered toner.

Because the spring 73 applies an action for raising the toner container 20, the toner container 20 can be brought up by a specific amount by using the spring force. That is, because the toner container 20 is held at the setting position such that the engaging pawl or the like engages as described above, when taking out the toner container 20, this container is brought up by means of the spring 73 by releasing this engaging pawl or the like. Thus, the operability upon taking out the toner container 20 can be improved by constructing this toner container 20 to be popped up. Further, because the mouth ring 23 of the toner container 20 is pressed against the jaw portion 75 of the supporting frame 72, it receives a stabilized upward pushing action.

Figure 16:
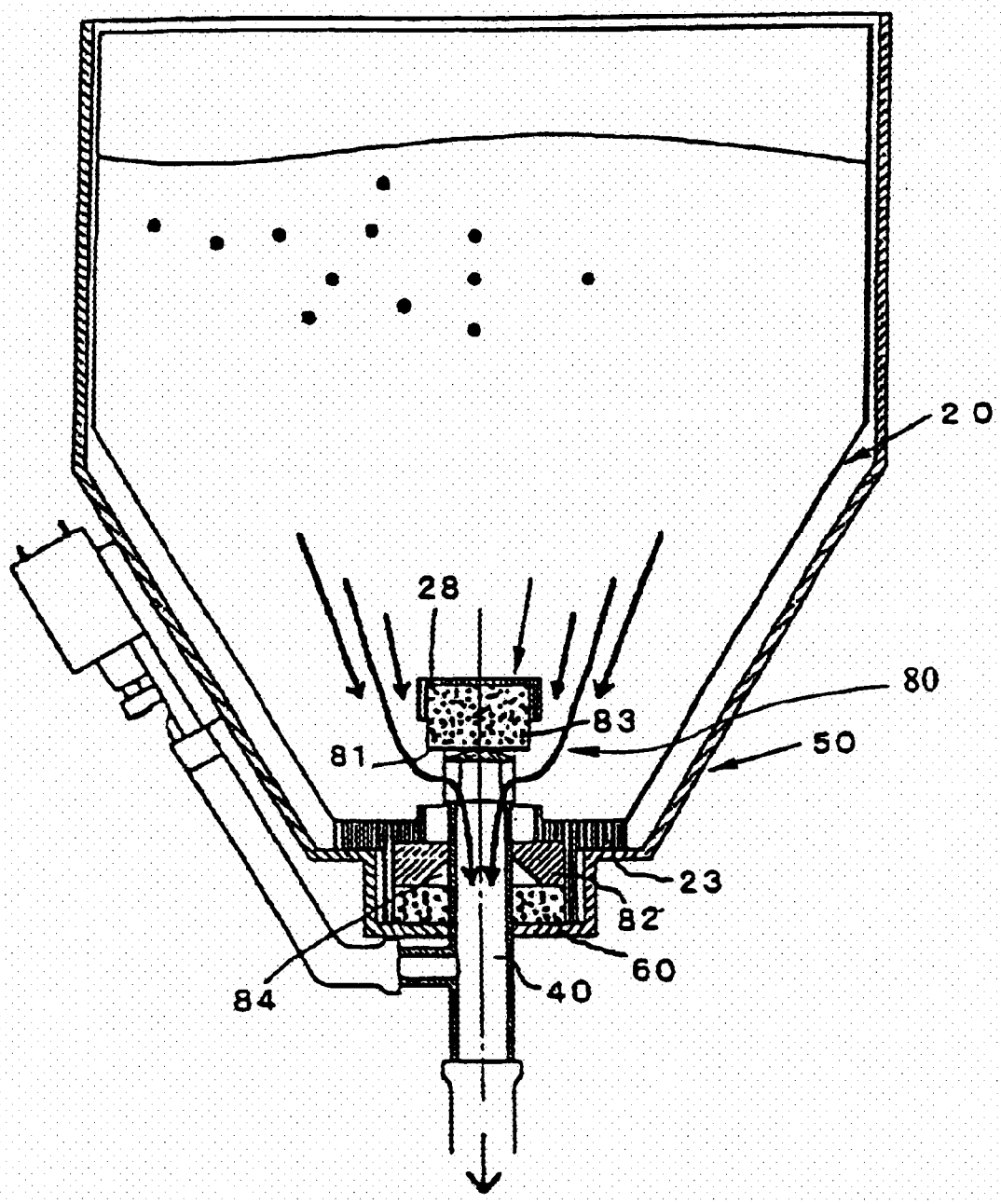
FIG. 16 is an explanatory sectional diagram of the setting portion according to further other embodiment of the present invention.

FIG. 16 is a sectional view of the setting portion 50 showing further other embodiment of the present invention.

Figure 17:
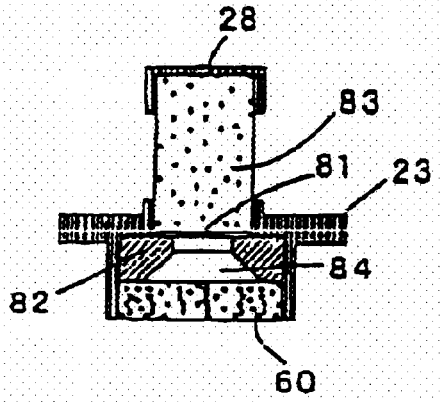
FIG. 17 is an explanatory sectional diagram showing an opening/closing valve when the toner container is not set up.

Referring to FIG. 16, the toner container 20 is provided with an opening/closing valve 80, which is opened/closed by the nozzle 40 and the aforementioned sealing valve 60 as a unit for preventing toner contamination. The opening/closing valve 80 includes a valve body 81 which is opened/closed by mounting or unloading the nozzle 40, a valve seat 82 on which that valve body is settled, and an elastic rubber 83 as an elastic member for applying elastic force to the valve body 81 in a direction that it always rests on the valve seat 82. In this opening/closing valve 80, the valve seat 82 is supported directly by the mouth ring 23, while the valve body 81 and the elastic rubber 83 are supported by the mouth ring 23 via the bracket 28. A hole 84, which the nozzle 40 passes through, is formed in the valve seat 82 and when the container is not set up, as shown in FIG. 17, the valve body 81 rests on the valve seat 82 such that it closed this hole 84 from above. Further, the sealing valve 60 is made of elastic foamed body such as sponge and the cross-shaped slits 65 are formed in the center thereof. Meanwhile, the elastic member is not restricted to the elastic rubber 83, but may be formed of resin or the like having a restoration force.

In the toner supply unit having such a structure, if the toner container 20 is set up in the setting portion 50, the slits 65 in the sealing valve 60 are pushed wide in the axial directions by the nozzle 40 and further, the nozzle 40 passes through the valve seat 82, so that it raises the valve body 81 resisting an action of the elastic rubber 83, and then, the nozzle 40 is inserted until the opening portion 40*a* invades into the container. If the toner container 20 is taken out, the valve body 81 rests on the valve seat 82 due to a restoration force of the elastic rubber 83, so as to shut down between inside and outside of the container thereby ensuring air tightness. In the same way, the sealing valve 60 is restored to its own original state due to the self-restoration force. At this time, if viewed from the side of the nozzle 40, the sealing valve 60 moves upward with the nozzle 40 in firm contact therewith, so that the slits 65 close gradually. As a result, this not only prevents toner from dropping from the nozzle but also provided an effect of cleaning the nozzle 40.

If only the sealing valve 60 is provided, the toner container 20 can be provided with some extent of air tightness and however, when it is loaded or unloaded, toner leaks through a gap between the nozzle 40 and the valve seat 82. Thus, in this case, it is difficult to prevent toner scattering. Even if this leakage is intended to be suppressed by controlling an engagement tolerance in dimension between the nozzle 40 and the hole 84 of the valve seat 82 strictly in order to suppress the leakage, toner which is fine powder penetrates into the gap, adheres due to electrostatic force by friction or van del Waals force, unlike liquid. Thus, there is a possibility that the nozzle 40 and the valve seat 82 may be locked so that they do not move. Further, if the tolerance is set strictly, a setting force of the container increases. Therefore, because if such elastic body as rubber, fine cell sponge is used for the valve seat 82, a force in the diameter direction is released by that elasticity, air-tightness can be obtained without increasing the setting force.

Further, if only the sealing valve 60 is employed, there is a possibility that the elastic body may undergo creep deformation due to leaving for a long period, so that an excellent air-tightness in the container cannot be secured. Therefore, by providing the opening/closing valve 80 with a function for securing air-tightness of the container like the above described embodiment and further providing the sealing valve 60 with cleaning function for reducing toner scattering, the toner leakage from the toner container 20 and the toner scattering upon loading/unloading can be reduced at the same time.

Figure 18A:
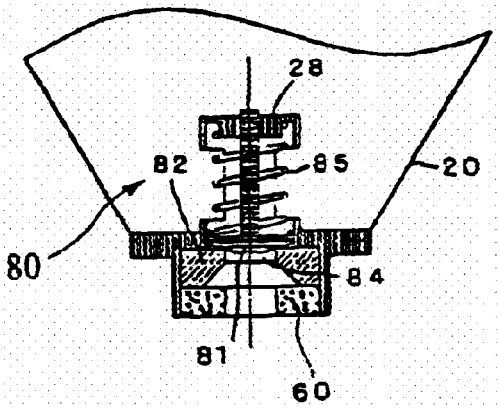
FIG. 18A and FIG. 18B are explanatory sectional diagrams showing an opening state and a closing state of the opening/closing valve according to the modification of FIG. 16.
Figure 18B:
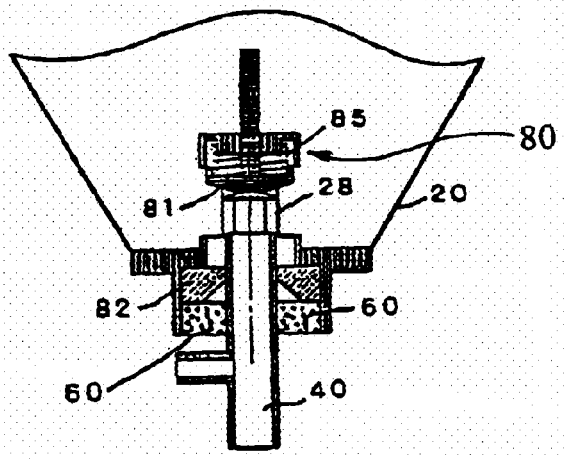

FIG. 18A and FIG. 18B show a modification of the embodiment shown in FIG. 16, in which a coil spring 85 is used as the elastic member of the opening/closing valve 80. If resin or rubber is employed as the elastic member, its restoration force may drop because of creep deformation generated by repeated use or leaving for a long period thereby leading to reduction in the air-tightness of the container. Thus, if the coil spring 85 is used, the deterioration due to repeated use never occurs, so that the air-tightness of the container can be secured.

Although as described above, toner contamination, which is generated by toner leakage from the sealing valve 60 can be prevented according to the present invention, it is difficult to eliminate the leakage of toner which is fine powder completely. Particularly, even if the toner leakage can be reduced in such an unfavorable situation where the toner container 20 is inserted or removed repeatedly or left for a long period, this cannot be reduced to zero.

Figure 19:
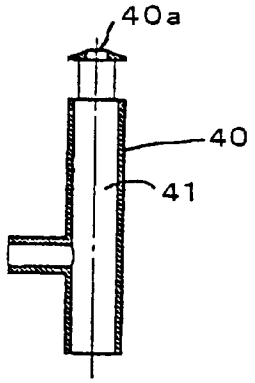
FIG. 19 is an explanatory sectional diagram of the nozzle according to further other embodiment of the present invention.

According to the embodiment shown in FIG. 19, a top end of the nozzle 40 is provided with an opening 40*a* so as to catch up toner cleaned by the sealing valve 60 or toner leaking from the slits 65. Then, by constructing the opening 40*a* as an opening for toner receiving for the toner aisle 41 connected to the developing unit 10, caught up toner can be consumed without waste.

With such a structure, it is possible to reduce the possibility that toner cleaned by the sealing valve 60 or toner leaking from the slits 65 may be scattered so as to contaminate the setting portion 50 and the toner container 20.

Figure 20:
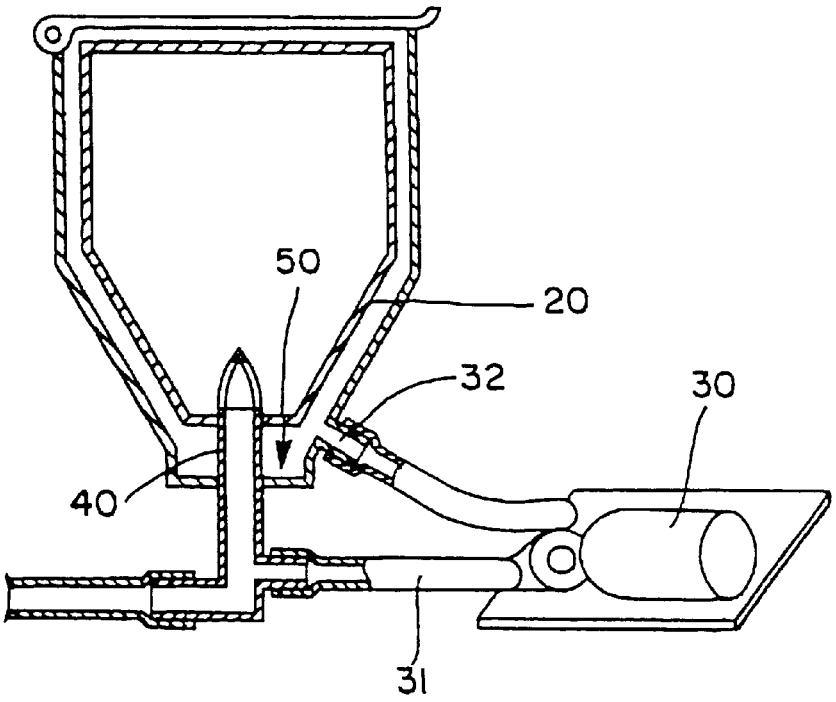
FIG. 20 is an explanatory diagram of the setting portion according to further other embodiment of the present invention.

According to the embodiment shown in FIG. 20, a suction port 32 of the air pump 30 which supplies air into the inside of the toner container 20 is disposed in the vicinity of the nozzle of the setting portion 50.

With such a structure, even if toner leaks from the sealing valve 60 in the toner container 20, the toner can be sucked and cleaned by an activation of the air pump 30. Thus, contamination of the setting portion 50 and the toner container 20 by leaking toner is reduced to a large extent.

The toner container 20 described in the above embodiment is comprised of the flexible toner bag 21 and the external box 22 having stiffness for covering it. Then, the toner bag 21 is formed such that its sectional area decreases as it goes to the mouth ring 23 having a toner discharging portion.

However, under such a structure, if the toner container 20 receives any impact, the toner bag 21 may be sometimes buckled at that squeezing portion. Particularly, because the toner bag 21 is softened under high temperatures, it is likely to be buckled.

Figure 21:
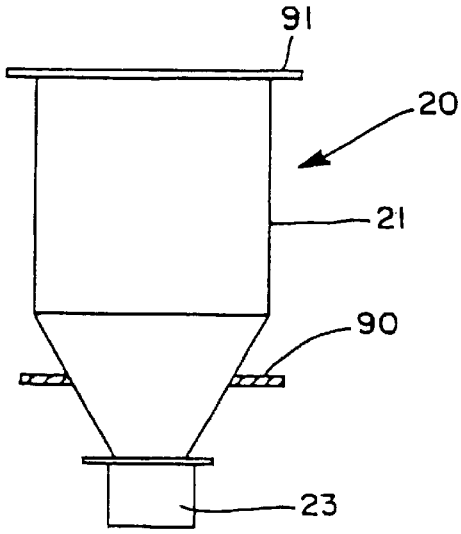
FIG. 21 is an explanatory diagram showing the toner container for preventing buckling of a toner bag.

As shown in FIG. 21, in order to prevent such buckling, a supporting plate 90 for supporting the squeezing portion of the toner bag 21 is provided. This supporting plate 90 is mounted on the external box 22 not shown in FIG. 21.

Figure 22:
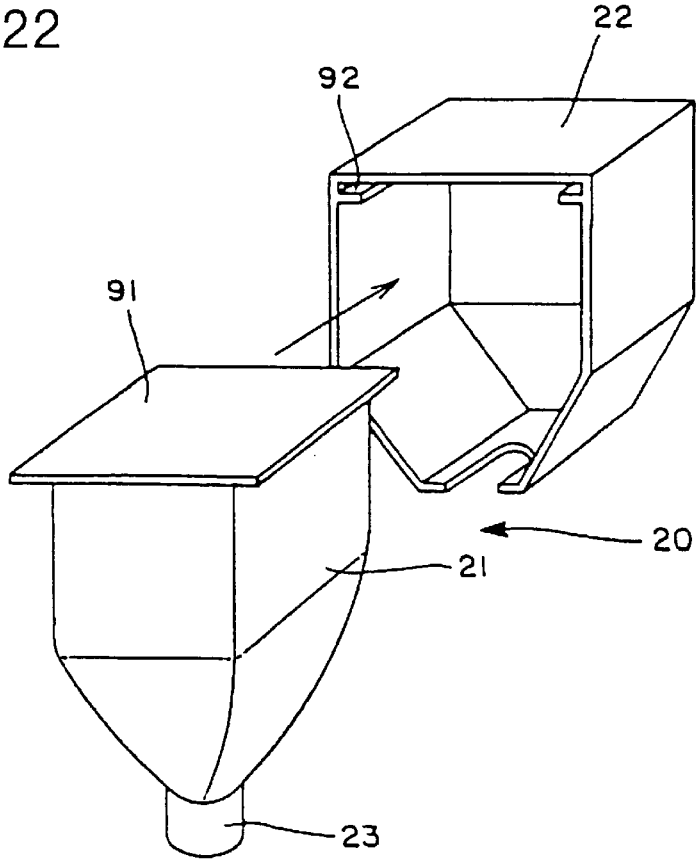
FIG. 22 is a perspective view showing the toner container for preventing buckling of the toner bag.
Figure 23:
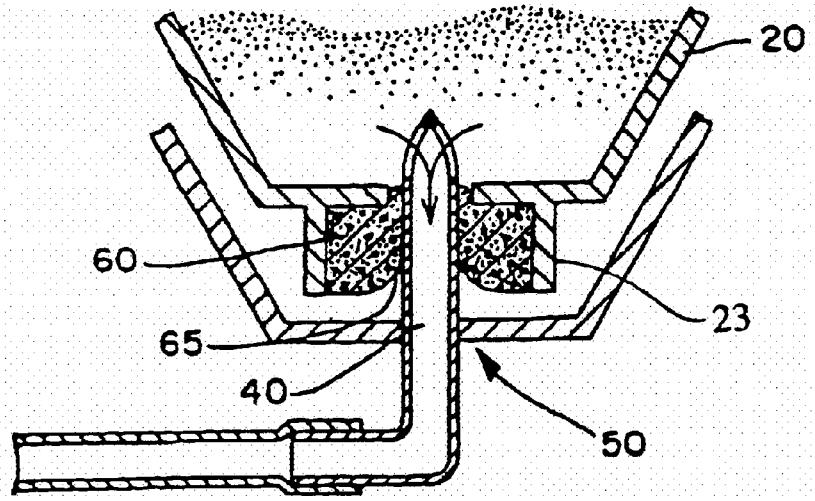
FIG. 23 is an explanatory sectional diagram showing an example of a proposed toner supply unit.
Figure 24:
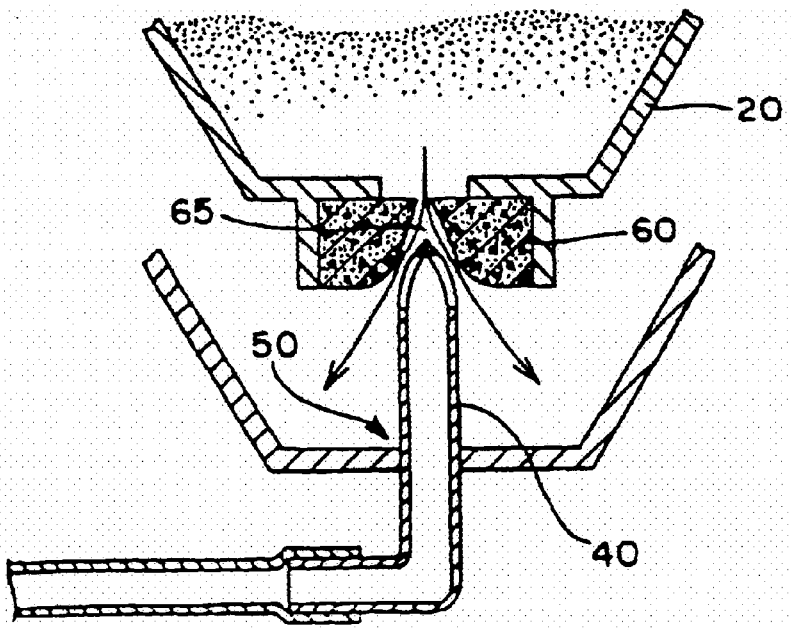
FIG. 24 is an explanatory diagram showing a problem in the toner supply unit of FIG. 23.

Further, to prevent the aforementioned buckling, a top plate 91 is fixed on top of the toner bag 21 and then, this top plate is loaded in a slide guide portion 92 formed in the external box 22 by sliding as shown in FIG. 22.

Embodiments of the present invention have been described above. However, the present invention is not restricted to the above described embodiments, however may be modified in various ways.

For example, the insertion member is preferred to be a nozzle having a circular cross section, and however, the shape of the nozzle is not restricted to circular, but may be elliptic, polygon or the like. However, if it is polygon, it is preferred to be of regular polygon with its corners rounded.

As explained above, according to the present invention, when the self-closing valve made of foamed elastic body facilitating removal or insertion of the insertion member of the toner container is provided, leakage of toner from the self-closing valve can be reduced to a large extent.

Furthermore, the insertion member can be inserted into the center of the slits in the self-closing valve, so that toner leakage which is generated when the insertion position of the insertion member deflects can be prevented.

Moreover, the insertion member can be inserted securely into the center of the slits in the self-closing valve.

Furthermore, the unit for guiding the insertion member to be inserted into the center of the slits in the self-closing valve can be provided with color non-compatible function.

Moreover, toner leakage from the self-closing valve of the toner container can be reduced to a large extent.

Furthermore, toner leaking from the self-closing valve can be introduced into the toner aisle.

Moreover, air-tightness between the insertion member and the self-closing valve is intensified, so that toner leakage from the self-closing valve can be reduced to a large extent.

Furthermore, toner leakage from the self-closing valve can be reduced and further, even if toner leaks, scattering thereof can be prevented securely.

Moreover, because the toner container is pushed by the jaw portion having a width, the container can be raised upward stably.

Furthermore, the opening/closing valve can be provided with a function for securing air-tightness of the container and further, the sealing valve of foamed elastic body can be provided with a cleaning function for reducing scattering of toner.

Moreover, the air-tightness of the toner container can be intensified by improving the closing state of the opening/closing valve.

Furthermore, such deterioration in setting operability that a large force is required when setting the toner container can be prevented.

Moreover, even if toner leaks from the self-closing valve of the toner container, most of the toner can be introduced to the toner aisle in the insertion member.

Furthermore, even if toner leaks from the self-closing valve of the toner container, that toner can be cleaned.

Moreover, the aforementioned cleaning action can be obtained from an air pump for supplying air to the toner container.

The present document incorporates by reference the entire contents of Japanese priority document, 2000-297354 filed in Japan on Sep. 28, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A toner supply unit comprising:

a toner container configured to hold a toner and having a toner discharging portion for discharging the toner;

a toner container holder configured to hold the toner container such that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a preventing unit for preventing toner contamination due to toner leakage, the preventing unit being provided to the toner discharging portion and including a self-closing valve configured to close by removing the insertion member from the toner discharging portion and open by inserting the insertion member into the toner discharging portion, wherein the toner discharging portion is provided with a plurality of the self-closing valves at least one of which is made of foamed elastic body.

2. A toner supply unit comprising:

a toner container configured to hold a toner and having a toner discharging portion for discharging the toner;

a toner container holder configured to hold the toner container such that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a preventing unit for preventing toner contamination due to toner leakage, the preventing unit being provided to the toner discharging portion and including a self-closing valve configured to close by removing the insertion member from the toner discharging portion and open by inserting the insertion member into the toner discharging portion, wherein the preventing unit further includes a guide unit which matches the insertion member with a slit position in the self-closing valve while the toner container is held by the toner container holder.

3. The toner supply unit according to claim 2, wherein the guide unit includes a guide convex portion erected in the vicinity of the insertion member and a guide concave portion provided on the toner container and configured to engage with the guide convex portion.

4. The toner supply unit according to claim 3, wherein the height of the guide convex portion is larger than the height of the insertion member.

5. The toner supply unit according to claim 3, wherein the guide convex portion and guide concave portion are configured to engage with each other based on a type of toner stored in the toner container.

6. A toner supply unit comprising:

a toner container configured to hold a toner and having a toner discharging portion for discharging the toner;

a toner container holder configured to hold the toner container such that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a preventing unit for preventing toner contamination due to toner leakage, the preventing unit being provided to the toner discharging portion and including a self-closing valve configured to close by removing the insertion member from the toner discharging portion and open by inserting the insertion member into the toner discharging portion, wherein the insertion member further comprises an insertion portion configured to be inserted into slits in the self-closing valve and a compression portion provided on side portions of the insertion portion for compressing the self-closing valve.

7. The toner supply unit according to claim 6, wherein the length of the insertion portion is smaller than a natural length of the self-closing valve and larger than its compressed length.

8. The toner supply unit according to claim 6, wherein an opening leading to the passage in the insertion member is formed in the compression portion.

9. A toner supply unit comprising:

a toner container configured to hold a toner and having a toner discharging portion for discharging the toner;

a toner container holder configured to hold the toner container such that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a preventing unit for preventing toner contamination due to toner leakage, the preventing unit being provided to the toner discharging portion and including a self-closing valve configured to close by removing the insertion member from the toner discharging portion and open by inserting the insertion member into the toner discharging portion, wherein the self-closing valve comprises foamed elastic body disposed with space in an insertion direction of the insertion member.

10. The toner supply unit according to claim 9, wherein a movable seal, which is moved by removing or inserting the insertion member, is provided in the space in the insertion member.

11. A toner supply unit comprising:

a toner container configured to hold a toner and having a toner discharging portion for discharging the toner;

a toner container holder configured to hold the toner container such that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a preventing unit for preventing toner contamination due to toner leakage, the preventing unit being provided to the toner discharging portion and including a self-closing valve configured to close by removing the insertion member from the toner discharging portion and open by inserting the insertion member into the toner discharging portion, wherein:

the preventing unit includes a toner leakage preventing unit configured to engage with the insertion member, the toner leakage preventing unit being movable in a vertical direction following the toner container when the toner container is loaded or unloaded;

the toner leakage preventing unit comprises a seal made of foamed elastic body provided on a face opposing the toner container, a supporting frame for supporting the seal and an elastic unit for applying a pushing-up force to the supporting frame; and the supporting frame is formed in a concave shape having a guide hole configured to engage the insertion member substantially in the center thereof while a seal is provided inside the concave formation.

12. The toner supply unit according to claim 11, wherein a jaw portion is formed on top of the supporting frame, so that when the toner container is removed from the toner container holder, the toner container is raised by the jaw portion.

13. A toner supply unit comprising:

a toner container configured to hold a toner and having a toner discharging portion for discharging the toner;

a toner container holder configured to hold the toner container such that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a preventing unit for preventing toner contamination due to toner leakage, the preventing unit being provided to the toner discharging portion and including a self-closing valve configured to close by removing the insertion member from the toner discharging portion and open by inserting the insertion member into the toner discharging portion, wherein the preventing unit is comprised of an opening/closing valve, in which when the insertion member is removed, a valve body rests on a valve seat provided on the discharging portion and a self-closing valve made of foamed elastic body provided outside the opening/closing valve in the discharging portion.

14. The toner supply unit according to claim 13, wherein the opening/closing valve is provided with an elastic member which urges the valve body toward the valve seat.

15. The toner supply unit according to claim 14, wherein the elastic member comprises a coil spring.

16. The toner supply unit according to claim 13, wherein the valve seat comprises an elastic body.

17. A toner supply unit comprising:

a toner container configured to hold a toner and having a toner discharging portion for discharging the toner;

a toner container holder that detachably holds the toner container in such a manner that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a suction unit having a suction port positioned to suction the toner leaked between the toner container holder and toner discharging portion of the toner container held by the toner container holder.

18. The toner supply unit according to claim 17, wherein the suction unit comprises an air pump provided for feeding air into the toner container.

19. An image forming apparatus comprising a toner supply unit, the toner supply unit including:

a toner container configured to hold a toner and having a toner discharging portion for discharging the toner;

a toner container holder that detachably holds the toner container in such a manner that the toner discharging portion faces in a direction of gravity;

an insertion member configured to be inserted into the toner discharging portion while the toner container is held by the toner container holder, the insertion member having a passage configured to at least one of inject air into the toner container and dispense the toner from the toner container; and a suction unit having a suction port positioned to suction the toner leaked between the toner container holder and toner discharging portion of the toner container held by the toner container holder.

* * * * *